US005271804A

United States Patent [19]

Muller et al.

[11] Patent Number: 5,271,804

[45] Date of Patent: Dec. 21, 1993

[54] ETCHANT/DEOXIDIZER FOR ALUMINUM

[75] Inventors: Frank A. Muller; David J. Tomlinson, both of Los Angeles County, Calif.

[73] Assignee: Elf Atochem North America, Inc., Philadelphia, Pa.

[21] Appl. No.: 970,658

[22] Filed: Nov. 3, 1992

[51] Int. Cl.[5] ..... B44C 1/22; C23F 1/00

[52] U.S. Cl. ..... 156/665; 134/3; 252/79.3; 427/309

[58] Field of Search ..... 252/79.2, 79.3, 79.4, 252/142; 156/656, 665; 134/3, 41; 427/309

[56] References Cited

U.S. PATENT DOCUMENTS 4,886,616 12/1989 Yamasoe et al. ..... 252/79.2 X 4,980,076 12/1990 Tanaka et al. ..... 252/79.2 X

*Primary Examiner*—William A. Powell

*Attorney, Agent, or Firm*—William D. Mitchell; Stanley A. Marcus

[57] ABSTRACT

In the etching and deoxidizing of aluminum, suppression of aluminum oxyfluoride crystal formation by the incorporation of phosphoric acid into an etchant/deoxidizer solution containing water, ferric sulfate, nitric acid, and HF or fluoride salts.

5 Claims, No Drawings

ETCHANT/DEOXIDIZER FOR ALUMINUM

FIELD OF THE INVENTION

The present invention relates to improved, non-chromated, etchant/deoxidizer solutions for aluminum, especially to solutions containing ferric sulfate, nitric acid, and a hydrofluoric acid/phosphoric acid component used to etch and deoxidize aluminum prior to non-destructive penetrant testing, conversion coating, and painting, the phosphoric acid serving to suppress the crystallization of aluminum fluoride and aluminum oxyfluoride.

BACKGROUND OF THE INVENTION

Both alkaline and acid processes have been used for etching aluminum. The alkaline process for etching aluminum in its simplest form utilizes sodium hydroxide solutions. In time, the concentration of dissolved aluminum in the etch tank increases to the point where the walls and bottom of the tank are covered with a hard crust, mainly of sodium aluminate. Further, the copper and manganese constituents of most structural aluminum alloys form a black deposit on the etched aluminum. Compositions containing chromic acid or nitric acid as the principal oxidizers must be used to remove this black deposit, commonly known as "smut."

More recent etchant/deoxidizer compositions that eliminate environmentally controlled chromic acid contain mixtures of water, ferric sulfate, nitric acid, and fluoride chemicals such as hydrofluoric acid and its salts. The acid process for etching aluminum eliminates the requirement of redissolving the black deposit of copper and manganese salts. As in the alkaline process, however, in time the concentration of dissolved aluminum in this acid medium builds up until an aluminum oxyfluoride precipitate forms.

Thus, there is a need for an etchant/deoxidizer which reduces or eliminates the need for constantly removing crystals from the bottom and sides of tanks.

SUMMARY OF THE INVENTION

An etchant/deoxidizer solution for aluminum is provided containing water, ferric sulfate, nitric acid, and a hydrofluoric ("HF")/phosphoric acid component which can be made up of:

(a)

(i) hydrofluoric acid or fluoride salts, such as sodium, potassium, and ammonium bifluorides, and (ii) phosphoric acid; or (b) a fluorophosphoric acid.

The invention also provides a method for etching and deoxidizing aluminum which comprises contacting the aluminum with an effective amount of the foregoing etchant/deoxidizer solution, preferably involving dipping of the aluminum into a bath of the solution.

Aluminum includes pure aluminum and alloys thereof including extrusions, cast, wrought, and sintered alloys. Examples of such alloys include those containing copper and/or manganese, such as 2024T3 (a commercial aluminum alloy containing about 4% by weight copper), as well as silicon-containing aluminum alloys.

DETAILED DESCRIPTION OF THE INVENTION

It was found that incorporation of phosphoric acid (or a fluorophosphoric acid) with the water, ferric sulfate, nitric acid, and hydrofluoric acid (or fluoride salts) unexpectedly resulted in suppression of the aluminum oxyfluoride precipitate to such an extent that the etching solution remained clear and no settling in the container was observed after processing of (2024T3) aluminum panels by dipping the same into the improved etchant/deoxidizer solution.

The solutions typically have a compositional makeup, in weight %, based on the total weight of the solution, of about 5-50% water (preferably 19-34%); about 6-50% ferric sulfate as a 49-50% solution (preferably 22-35%); about 10-60% nitric acid (at 68% strength), preferably 30-52%; and about 1.1 to 35% of the HF/phosphoric acid component (preferably 1.1 to 16%). If the HF/phosphoric acid component is comprised of hydrofluoric acid (or a fluoride salt) and phosphoric acid, the hydrofluoric acid (as 70% HF) typically comprises 1-15% of the solution (preferably 1-6%) and the phosphoric acid (as 75% phosphoric acid) typically comprises 0.1 to 20% of the solution (preferably 0.1-10%). The fluorophosphoric acid can be mono-, di-, or hexa-fluorophosphoric acid, the di- and hexa- forms being preferred for economic reasons.

By way of illustration, when the following formulation was made up in a 2 gallon quantity and used to process 241 3-inch by 10-inch 2024T3 aluminum panels, no crystals of aluminum oxyfluoride resulted:

| Component | Weight % |
|---|---|
| water | 23.9 |
| ferric sulfate (49%) | 28.5 |
| nitric acid (68%) | 43.3 |
| hydrofluoric acid (70%) | 3.1 |
| phosphoric acid (75%) | 1.2 |

In the same test, but without the phosphoric acid, 20 grams of aluminum oxyfluoride crystals were produced.

Another preferred embodiment of the invention involves a solution made up of 27.9% water, 28.5% of the ferric sulfate solution, 38.3% of nitric acid, and 5.3% difluorophosphoric acid. This solution was tested by leaving 2024T3 aluminum panels submerged in one gallon of the solution until 41.5 grams of the alloy had dissolved (over a 2½ hour period). Again, no crystals resulted.

Preparation of the solution does not involve any unique steps. A typical procedure would be to add the ferric sulfate to the water, followed by the nitric acid, then the HF, and finally the phosphoric acid.

In a typical application of the solution, the aluminum would be cleaned to remove soils (such as with an alkaline cleaner), rinsed, dipped in the etchant/deoxidizer solution for about 10 minutes (depending on the desired degree of etching), rinsed again, then subjected to penetrant testing and/or conversion coating baths, and painted.

What is claimed is:

1. An etchant/deoxidizer solution for aluminum comprising water, ferric sulfate, nitric acid, and an HF/phosphoric acid component selected from the group consisting of (a)(i) hydrofluoric acid or fluoride salts and (ii) phosphoric acid, or (b) a fluorophosphoric acid.

2. An etchant/deoxidizer solution as in claim 1 wherein the HF/phosphoric acid component is hydrofluoric acid and phosphoric acid.

3. An etchant/deoxidizer solution as in claim 1 wherein the HF/phosphoric acid component is difluorophosphoric acid.

4. A method for etching and deoxidizing aluminum which comprises contacting aluminum with an effective amount of the etchant/deoxidizer solution of claim 1.

5. The method of claim 4 wherein the aluminum is contacted by dipping it into the etchant/deoxidizer solution.

* * * * *